US007283761B2

(12) United States Patent
Matsuda et al.

(10) Patent No.: US 7,283,761 B2
(45) Date of Patent: Oct. 16, 2007

(54) DEVELOPING APPARATUS AND IMAGE FORMING APPARATUS, AND STORAGE APPARATUS

(75) Inventors: Kenji Matsuda, Numazu (JP); Hideki Matsumoto, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 179 days.

(21) Appl. No.: 11/082,830

(22) Filed: Mar. 18, 2005

(65) Prior Publication Data

US 2005/0207769 A1 Sep. 22, 2005

(30) Foreign Application Priority Data

Mar. 22, 2004 (JP) ..... 2004-082408
Feb. 28, 2005 (JP) ..... 2005-053341

(51) Int. Cl.
*G03G 15/08* (2006.01)

(52) U.S. Cl. ..... 399/53; 399/281; 399/283

(58) Field of Classification Search ..... 399/53, 399/279–286

See application file for complete search history.

(56) References Cited

U.S. PATENT DOCUMENTS

| | | | | |
|---|---|---|---|---|
| 5,136,776 | A | 8/1992 | Yanagisawa | 29/740 |
| 6,058,284 | A | 5/2000 | Okano et al. | 399/284 |
| 6,701,113 | B2 | 3/2004 | Matsuda et al. | 399/263 |

FOREIGN PATENT DOCUMENTS

| | | | |
|---|---|---|---|
| JP | 4-30599 | | 2/1992 |
| JP | 9-211957 | | 8/1997 |
| JP | 09222787 | A * | 8/1997 |
| JP | 2003-122121 | | 4/2003 |
| JP | 2003255678 | A * | 9/2003 |

* cited by examiner

*Primary Examiner*—David M. Gray
*Assistant Examiner*—Ryan Gleitz
(74) *Attorney, Agent, or Firm*—Fitzpatrick, Cella, Harper & Scinto

(57) ABSTRACT

The developing apparatus which develops a latent image formed on an photosensitive drum by a toner is provided with a developing roller which bears the toner, and an RS roller abutting against to this developing roller so as to perform the removal and supply of the toner on the photosensitive drum, and at the same time, is provided with adjusting means which adjusts a pushed-in amount for the developing roller of the RS roller according to the characteristic of the RS roller.

17 Claims, 14 Drawing Sheets

| LIFE INFORMATION (L) | L1 | L2 | L3 | L4 |
|---|---|---|---|---|
| PUSH-IN AMOUNT INFORMATION (d) | dL1 | dL2 | dL3 | dL4 |

FIG. 17

| | SMALL OUTER DIAMETER | LARGE OUTER DIAMETER |
|---|---|---|
| REMOVAL CAPABILITY | LOW | HIGH |
| SUPPLY CAPABILITY | LOW | HIGH |
| DRIVING TORQUE | LOW | HIGH |

FIG. 18

| | LARGE NUMBER OF CELLS | SMALL NUMBER OF CELLS |
|---|---|---|
| REMOVAL CAPABILITY | HIGH | LOW |
| SUPPLY CAPABILITY | LOW | HIGH |
| DRIVING TORQUE | HIGH | LOW |

FIG. 19

| | HIGH HARDNESS | LOW HARDNESS |
|---|---|---|
| REMOVAL CAPABILITY | HIGH | LOW |
| DRIVING TORQUE | HIGH | LOW |

DEVELOPING APPARATUS AND IMAGE FORMING APPARATUS, AND STORAGE APPARATUS

BACKGROUND OF THE INVENTION

1. Field of the Invention

The present invention relates to a developing apparatus and an image forming apparatus comprising this developing apparatus and a storage apparatus to be used in an image forming process of an electrophotographic system.

2. Related Background Art

Heretofore, in general, in an image forming apparatus using an image forming process of an electrophotographic system, as a developing apparatus which develops an electrostatic latent image formed on a photosensitive member by a developer (toner), the developing apparatus using a non-magnetic toner has been known.

In such a developing apparatus, a configuration has been widely adopted, in which a developing roller which is a toner bearing member which bears a toner, and a removing supply roller (hereinafter referred to as RS roller) which is a member that supplies the toner on the surface of this developing roller or removing the toner on the surface of the developing roller or performing both removing and supplying are provided, and this RS roller is disposed so as to abut against the developing roller.

Citing one example of the RS roller, there is a roller consisting of a sponge layer and a cored bar, which rotates in a counter direction for a developing roller with a predetermined peripheral velocity. The developing roller and the RS roller are abutted against each other with a predetermined pushed-in amount, whereby the toner of the developing roller is removed, and the toner is supplied to the developing roller.

Here, the above described pushed-in amount is a value showing how far an outer diameter (virtual outer diameter) of the RS roller pushes into the outer diameter of the developing roller, which can be found by a value subtracting a center distance between the developing roller and the RS roller from the sum of the radius of the developing roller and the radius of the RS roller.

In the meantime, it has been well known that, by unitizing the developing apparatus and making it detachably attachable to an image forming apparatus main body, the improvement of maintainability can be attempted.

In such a developing apparatus, a method has been proposed, in which an operational status of the developing apparatus is detected, thereby an abutting pressure of the RS roller is changed, so that the deterioration of the toner due to an excessive toner removal capability is prevented under high temperature environment (for example, see Japanese Patent Application Laid-Open No. H9-211957).

Further, a method has been proposed, in which, to prevent a permanent deformation of the RS roller in a long term storage of the developing apparatus, the RS roller is isolated from the developing roller when the developing apparatus is detached from the image forming apparatus main body, and accompanied with an operation to mount the developing apparatus onto the image forming apparatus main body, the developing roller and the RS roller are pressured (for example, see Japanese Utility Model Publication No. H4-30599).

Further, a method has been proposed, in which the RS roller is biased to the developing roller by biasing means, and in timing with the case where the RS roller is hardened due to permanence (toner clogging), the pushed-in amount of the RS roller is decreased (for example, see Japanese Patent Application Laid-Open No. 2003-122121).

Now, in recent years, a tendency toward high image quality has been advancing in the image forming apparatus of an electrophotographic system, and it has become of a crucial importance to properly adjust a removal capability of the RS roller for the developing roller and a supply capability of the toner to realize a high image quality. In the meantime, the RS roller has been suffering from irregularities of initial characteristics such as the toner removal capability and the toner supply capability of the RS roller due to a difference (maker difference) by a plurality of maker's plants and a plurality of makers, and a lot difference.

To restrain these irregularities, it has been necessary to make a production process complicated, or to tolerate these irregularities, it has been necessary to control, for example, the pushed-in amount of the RS roller for the developing roller with a high accuracy.

Furthermore, there has been a problem in that the RS roller gradually changes in the characteristics such as the toner removal capability and the toner supply capability due to elapse-time usage, and this change in the characteristics hinders a long life of the developing apparatus or the image quality ends up fluctuating in correspondence with the change in the characteristics.

Further, as described above, the RS roller rotates in a counter direction to the developing roller, and moreover, abuts against the developing roller with a predetermined pushed-in amount. Consequently, when the developing roller and the RS roller are rotationally driven, a load applied on the surface of the RS roller becomes extremely large, and in an initial usage stage, a tearing has often occurred in the RS roller due to this load. Hence, at the production time of the developing apparatus, a process of coating the toner in advance on the RS roller has been added, thereby preventing the tearing from occurring with the toner used as a lubricant.

Furthermore, there has been a problem that a starting torque when the developing roller and the RS roller are simultaneously driven in the developing apparatus is extremely large since the RS roller rotates in a counter direction for the developing roller, and abuts against the developing roller with a predetermined pushed-in amount, and by this difference of the starting torque due to the difference of characteristic, the rotation of the RS roller has ended up fluctuating, so that the image quality has often been fluctuated.

SUMMARY OF THE INVENTION

The present invention has been carried out in order to solve the above described problems, and an object of the invention is to provide a developing apparatus and an image forming apparatus as well as a storage apparatus capable of adjusting a pushed-in amount of a removal supply roller to a developing roller according to the characteristics of the removal supply roller and realizing a high image quality.

A further object of the invention is to provide a developing apparatus and an image forming apparatus as well as a storage apparatus capable of realizing a high image quality even when the characteristics of the removal supply roller (RS roller) vary, and at the same time, preventing a tearing of the RS roller, and preventing the deterioration of the developing roller, and further, reducing the starting torque of the developing roller and the RS roller.

Still further object of the present invention will be apparent from the reading of the following detailed description of the invention with reference to the accompanying drawings.

BRIEF DESCRIPTION OF THE DRAWINGS

FIG. 17 is a view showing an outer diameter and a tendency of each performance of a removal and supply roller (RS roller);

FIG. 18 is a view sowing the number of cells and the tendency of each performance of the removal and supply roller (RS roller); and FIG. 19 is a view showing a hardness of the material and the tendency of each performance of the removal and supply roller (RS roller).

DESCRIPTION OF THE PREFERRED EMBODIMENTS

Preferred embodiments of the present invention will be described below in detail with reference to the drawings. It will be appreciated that the scope of the present invention is not limited only to the size, material, shape, relative arrangements, and the like of component parts in the embodiments, unless particularly described otherwise.

First Embodiment

First, a first embodiment of the present invention will be described by using FIGS. 1 to 12.

Figure 1:
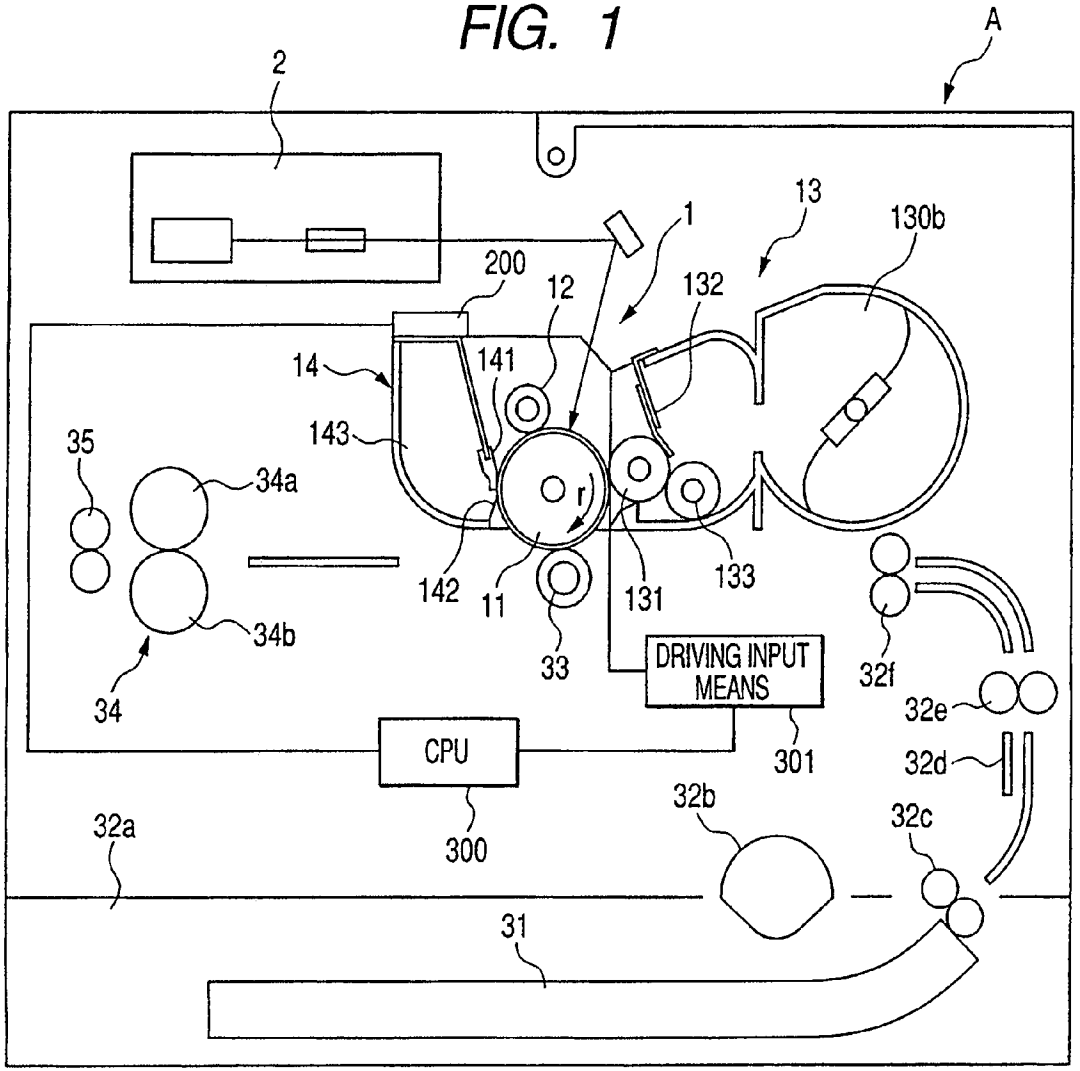
FIG. 1 is a sectional view showing a whole constitution of a laser beam printer of an electrophotographic system according to the present invention.

In the following description, a longitudinal direction is a direction same as the axial direction of a photosensitive drum (photosensitive drum 11) in an electrophotographic process, and further, up and down, and left and right, as shown in FIG. 1, are up and down, and left and right in an attached state of a cartridge in an installed state of an apparatus.

Further, in the present embodiment, though a description will be made on a developing apparatus in a mode contained in a process cartridge as developing means, in a mode in which the process cartridge and the developing apparatus are independent from each other, and also in the developing apparatus built into an image forming apparatus main body, the present invention can obtain the same advantages by the same constitution.

Further, as an example of the image forming apparatus of the electrophotographic system, an electrophotographic copier, an electrophotographic printer (for example, a laser beam printer, an LED printer, and the like), a facsimile machine, a word processor, and the like are included.

(Description of Whole Image Forming Apparatus)

First, a whole constitution of the image forming apparatus of the electrophotographic system will be described with reference to FIG. 1. FIG. 1 is a sectional view showing the whole constitution of a laser beam printer, which is one mode of the electrophotographic image forming apparatus according to the present invention.

The image forming portion of the laser beam printer of the present embodiment comprises a process cartridge 1 comprising a photosensitive drum 11 which is an image bearing member, and an exposing apparatus 2 (laser beam optical scanning system) disposed above the process cartridge 1.

Down below the image forming portion, there are disposed a sheet feeding portion which feeds a transferring material 31 which is a recording medium, and a transferring roller 33 which transfers a toner image formed on the photosensitive drum 11 onto the transferring material 31. Further, there are disposed a fixing device 34 which fixes the toner image transferred on the transferring material 31, and a discharge roller 35 which discharges and loading the transferring material 31 outside the apparatus. As the transferring material 31, for example, a paper, an OHP sheet or a cloth and the like are used.

Next, the constitution of each portion of the image forming apparatus will be descried in detail in order.

(Sheet Feeding Portion)

The sheet feeding portion is to feed the transferring material 31 to the image forming portion, and is mainly constituted by a feeding cassette 32*a* loading and storing a plural number of transferring materials 31, a feeding roller 32*b*, a retard roller 32*c* which prevents a double feeding, a feeding guide 32*d* and a registration roller 32*f*.

The feeding roller 32*b* is rotationally driven according to an image forming operation, and separates and feeds the transferring material 31 inside the feeding cassette 32*a* a sheet by sheet The transferring material 31 is prevented from a double feeding by the retard roller 32*c*, and is guided by the feeding guide 32*d*, and is conveyed to the registration roller 32*f* through a conveying roller 32*e*.

During the image forming operation, the registration roller 32*f* performs a non-rotational operation to allow the transferring material 31 to rest and wait, and a rotational operation which conveys the transferring material 31 to the photosensitive drum 11 at a predetermined sequence, and performs a positioning of the toner image and the transferring material 31 at the transferring process time which is a next process.

Right after the transferring material 31 is conveyed, the registration roller 32*f* stops rotating, and by hitting against its nip portion, the transferring material 31 is corrected in skewed feeding.

(Control Portion)

The image forming operation is controlled by a CPU 300. By a control program stored in an unillustrated ROM and the like inside the CPU in advance, the image forming operation and the control to be described below are performed. Further, the CPU 300 is connected to driving input means 301 (for example, motor and the like), and transmits a signal, for example, for driving the cartridge 1 to the driving input means 301. From the driving input means 301, a driving force is transferred to a driving gear to be described later, so that the cartridge is driven.

Further, the CPU 300 communicates with a memory 200 (storage means) provided in the cartridge 1 so as to be able to read and write information. The memory 200 is stored with information concerning the process cartridge, and based on that information, controls the operation of the image forming apparatus (the detail will be described later).

(Process Cartridge)

The process cartridge is an integral unitization of the photosensitive drum with charging means and the developing apparatus or cleaning means, and includes those detachably attachable to the image forming apparatus main body. Further, it includes those integrally unitizing at least one of the charging means, the developing apparatus, the transferring means, and the cleaning means with the photosensitive drum, thereby being detachably attachable to the image forming apparatus main body.

The process cartridge 1 in the present embodiment disposes a charging roller 12 which is charging means, a developing apparatus 13, and cleaning means 14 around the photosensitive drum 11 which is an image bearing member, and constitutes them integrally. This process cartridge 1 is constituted so as to be detachably attachable to an image forming apparatus main body A. Consequently, the user can easily detach this process cartridge 1, and can easily replace it when its life expires.

Further, the process cartridge 1 in the present embodiment, as shown in FIG. 1, rotates the photosensitive drum 11 which is an electrophotographic photosensitive member having a photosensitive layer in a direction to an arrow mark r, and applies a voltage to the charging roller 12 so as to uniformly charge the surface of the photosensitive drum 11, and exposes an optical image based on image information from the exposing means 2 onto this charged photosensitive drum 11 so as to form an electrostatic latent image, thereby developing this electrostatic latent image by the developing apparatus 13.

The above described developed toner image is transferred onto the transferring material 31 by applying a voltage of reverse polarity (toner image) to the transferring roller 33, and after that, a residual toner remained on the photosensitive drum 11 is swept off by a cleaning roller 141, and at the same time, is scooped up by a scoop sheet 142, and the residual toner on the photosensitive drum 11 is removed by the cleaning means 14 so as to be stored into a waste toner containing chamber 143.

(Fixing Portion)

Next, the constitution of a fixing portion will be described.

The toner image formed on the photosensitive drum 11 by the developing portion is transferred on the transferring material 31 by the transferring roller 33. The fixing device 34 fixes the toner image transferred on the transferring material 31 onto the transferring material 31 by using heat.

The fixing device 34 comprises a fixing roller 34*a* which applies heat to the transferring material 31 and a pressure roller 34*b* which pressures the transferring material 31 to the fixing roller 34*a*, and each roller is a hollow roller, and has a heater (not shown) inside, respectively. Each roller is rotationally driven so as to convey the transferring material 31 at the same time.

That is, the transferring material 31 which holds the toner image is conveyed by the fixing roller 34*a* and the pressure roller 34*b*, and at the same time, is fixed with the toner image by being applied with heat and pressure. The transferring material 31 after being fixed with the toner image is discharged by a discharge roller 35.

(Developing Apparatus)

Figure 2:
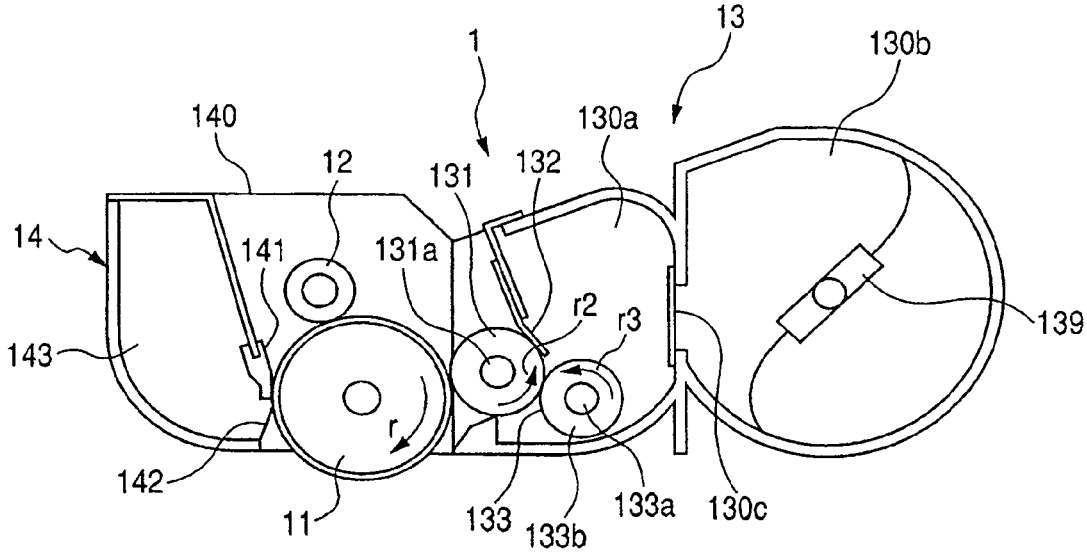
FIG. 2 is a section view showing a detailed constitution of a process cartridge of the embodiments of the present invention.

The developing apparatus in the present embodiment will be described by using FIG. 2. FIG. 2 is a sectional view showing the process cartridge 1 integrally constituted by the developing apparatus 13 of the present embodiment. As shown in the drawing, the developing apparatus 13 has a mode to be contained in the process cartridge 1. Although the developing apparatus 13 in the present embodiment has a toner containing chamber 130*b* and a developing chamber (developing portion) 130*a* integrally formed, even if they are separated, the same effect can be obtained.

The developing apparatus 13, at the production time, has the toner containing chamber 130*b* and the developing chamber 130*a* partitioned by a partition member 130*c*. This is to prevent the toner from flying outside from the developing apparatus 13 in a physical distribution process and the like, and when the developing apparatus 13 is used, the partition member 130*c* is opened.

The toner stored in the toner containing chamber 130*b* is conveyed to the developing chamber 130*a* by a toner conveying member 139, and is borne by the developing roller 131 which is a toner bearing member (developer bearing member), but at this time, the toner remained on the developing roller 131 is removed by the RS roller (removal supply roller) 133 right before a developing process, and at the same time, the toner is supplied to the developing roller 131 by the RS roller 133. Subsequently, the developing roller 131 is rotated in the direction to an arrow mark r2, and at the same time, a toner layer given with tribo-electrostatic charge by a developing blade 132 is formed on the surface of the developing roller 131, and the toner layer is transferred on the above formed photosensitive drum 11 so as to form a toner image and visualize it.

(RS Roller)

The RS roller 133 is a member which removes and supplying the toner, and is a roller having a foam layer 133*b* such as a urethane form and the like on a cored bar 133*a*, and abuts on the outer peripheral surface of the developing roller 131 in the upper stream side of the developing roller 131 from a developing blade 132, and is rotated and driven in a direction to an arrow mark r3.

Further, the RS roller 133, as described above, has a removal performance of removing the toner remained on the developing roller 131 and a supply performance of supplying the toner on the developing roller 131 as important functions.

When the removal performance is low, an image defect occurs, which is called as a ghost. This ghost is a phenomenon in which a portion only of the toner on the developing roller is developed, and there occurs a difference of charges between a portion newly borne on the portion used for development of the developing roller and given tribo-electrostatic charge by the developing blade, and a portion not used for the development but borne as it is and further given tribo-electrostatic charge by the developing blade, and when developed next time, the effect of the previous image appears.

Further, when the toner supply performance is low, an image defect occurs, which is so called as a lowering of the image density.

Incidentally, when a pushed-in amount of the RS roller 133 for the developing roller 131 is increased, both of the toner removal performance and the toner supply performance are prone to improve, but when the pushed-in amount is excessively increased, since harmful effects such as torque rise, furtherance of the tearing and permanent deformation of the RS roller 133 as well as deterioration of the toner and the like are brought about, the pushed-in amount is set in taking into consideration these effects.

In the meantime, the RS roller 133, as described above, is a roller having the foam layer 133*b*. Consequently, at the production time of the RS roller, there sometimes occur irregularities of the removal performance and the toner supply performance of the RS roller 133. As irregularity factors, there are an outer diameter, the number of cells (the number of foams per a unit volume), hardness and the like, and these factors minutely vary by differences of makers (even when they are the same makers) of the RS roller 133 and a lot difference.

Hence, the irregularity factors cited here, the effects of these factors on the removal performance and the supply performance of the RS roller 133, and moreover, the driving torque accompanied with the effects of these performances will be described.

First, as a first factor, the irregularity of the outer diameter of the RS roller will be described by using FIG. 17. FIG. 17 is a table showing the relation of features between the outer diameter and the removal performance, the supply performance, and the driving torque of the RS roller.

When the outer diameter of the RS roller 133 is decreased, the pushed-in amount for the developing roller 131 becomes small, and when the outer diameter becomes large, the pushed-in amount is increased.

Here, when the diameter is small as shown in the drawing, the removal performance and the supply performance are degraded, and when the driving torque is decreased and the outer diameter is increased inversely, the removal performance and the supply performance are upgraded, and moreover, the driving torque is increased. The reason why will be described below.

Since the toner removal of the RS roller 133 is a phenomenon to remove the toner on the developing roller surface by the sponge layer surface, if the diameter is small, it means that this removal force becomes small. Consequently, the removal performance is degraded.

Further, since the toner supply of the RS roller 133 is a phenomenon to press the toner loaded on the cell of the sponge layer to the developing roller, if the diameter is small, it means that this supply force becomes small. Consequently, the supply performance is degraded.

Further, the torque of rotationally driving the RS roller 133 becomes small when the outer diameter of the RS roller 133 is small, since frictional resistance with the developing roller 131 is decreased.

In case the diameter is large, since a phenomenon reverse to the phenomenon previously described occurs, the description thereof will be omitted.

Subsequently, as a second factor, the irregularity of the number of cells will be described by using FIG. 18. FIG. 18 is a table showing a relation of features between the number of cells and the removal capability, the supply capability, and the driving torque of the RS roller. The number of cells is the number of cells of the sponge for a unit superficial area. That is, when the number of cells is high, the diameter of one cell becomes small, and inversely when the number of cells is low, the diameter of one cell becomes large. Here, as shown in the drawing, when the number of cells is high, the removal performance is upgraded, and the supply performance is degraded, and the driving torque becomes high, and inversely when the number of cells is low, the removal performance is degraded, and the supply performance is upgraded, and further, the driving torque is decreased. The reason why will be described below.

Since the toner removal of the RS roller 133 is a phenomenon to remove the toner of the surface of the developing roller 133 by a partition wall separating a cell and a cell, when the number of cells is high (the diameter of one cell is small), by that much a contact chance between this partition wall and the surface of the developing roller 131 increases, thereby upgrading the removal performance.

Further, since the toner supply of the RS roller 133 is a phenomenon to press the toner surrounded by the cells at a portion contacting the developing roller 131, when the number of cells is high (the diameter of one cell is small), by that much the toner amount taken in the cells is decreased, thereby degrading the removal performance.

Further, the torque of rotationally driving the RS roller 133 ends up becoming large when the number of cells is high, since as described above, the contact chance between the partition wall and the surface of the developing roller 131 increases. In case the number of cells is low (in case the diameter of one cell is large), since a phenomenon reverse to the phenomenon previously described occurs, the description thereof will be omitted.

Next, as a third factor, the irregularity of hardness will be described by using FIG. 19. The hardness to be described here is a hardness of the material itself forming the sponge of the RS roller 133, and can be replaced by the hardness of the partition wall. FIG. 19 is a table showing the relation of features between the material hardness of the RS roller and the removal capability and the driving torque of the RS roller. As shown in the drawing, when the hardness is high, the removal performance is upgraded, and the driving torque is increased. Inversely, when the hardness is low, the removal performance is degraded, and the driving torque is decreased. The reason why will be described below.

As described above earlier, the removing of the toner on the developing roller is performed by the partition wall which forms the cells, and the hardness being high means that the removal force of the toner by the partition wall is large. Consequently, the hardness being high means that the removal performance is high. Naturally, at this time, since the frictional force with the developing roller becomes large, the driving torque is increased.

Further, there does not exist a distinct tendency as described so far with regard to the hardness and the supply performance. To describe the reason why, summing up the phenomenon of supplying the toner to the developing roller of the RS roller in short, the toner contained in the cell is pushed down by a nip portion so that the toner inside the cell is heaved up and rubbed on the surface, whereby the toner is adhered on the developing roller. That is, to upgrade the supply performance of the RS roller, the hardness to allow the toner inside the cell to heave up is required to be low to a certain extent, and the hardness which rubs is required to be high to a certain extent.

Hence, when the pushed-in amount for the developing roller 131 of the RS roller 133 is set, all these factors are required to be taken into consideration. However, the pushed-in amount to satisfy all these conditions has less margin. Consequently, to tolerate the irregularity of the production of the RS-roller 133, it is necessary to control the pushed-in amount of the developing roller 131 and the RS-roller at high accuracy.

However, with regard to the correlation between the factors of the irregularity and the respective performances as described above, it is a tendency of the case where a simple factor alone changes. With regard to actual irregularities, each of these factors changes independently, and the way of irregularity is also different, respectively. However, since a contribution ratio of the performances to the factor of each irregularity is all different, when each RS roller is built into the developing apparatus, the pushed-in amount for the developing roller is matched to the optimum condition according to the initial characteristic at the production time, so that the removal performance, the supply performance, and moreover, the driving torque can be used in a desired status.

Figure 3:
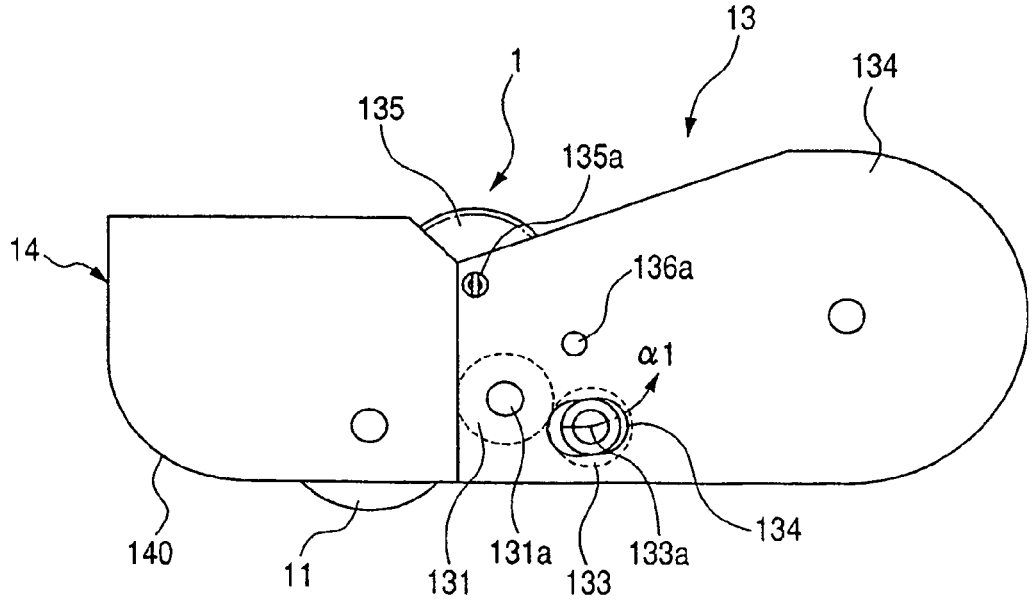
FIG. 3 is a side view showing a process cartridge in a first embodiment.

Hence, in the present embodiment, as shown in FIG. 3, the RS roller 133 is rockingly supported along the a guide groove 134*a*, and the pushed-in amount of the RS roller 133 for the developing roller 131 is adjusted, so that the RS roller 133 is used by the pushed-in amount matched to the characteristic of each RS-roller 133, thereby realizing a high image quality without causing the above described troubles.

(RS Roller Rocking Support)

Next, a rocking support constitution of the RS roller 133 will be described by using FIGS. 3 and 4.

FIG. 3 is a side view showing the process cartridge 1 in the present embodiment. As shown in the drawing, the side surface of the developing apparatus 13 is disposed with a developing side cover 134, and this developing side cover 134 is formed with a guide groove 134*a*. The guide groove 134*a* is composed of a circular arc shape with the center axis 136*a* of an RS roller driving gear 136 as a reference, and is engaged with an engaging portion 137*b* of an RS roller rocking bearing 137.

Figure 4:
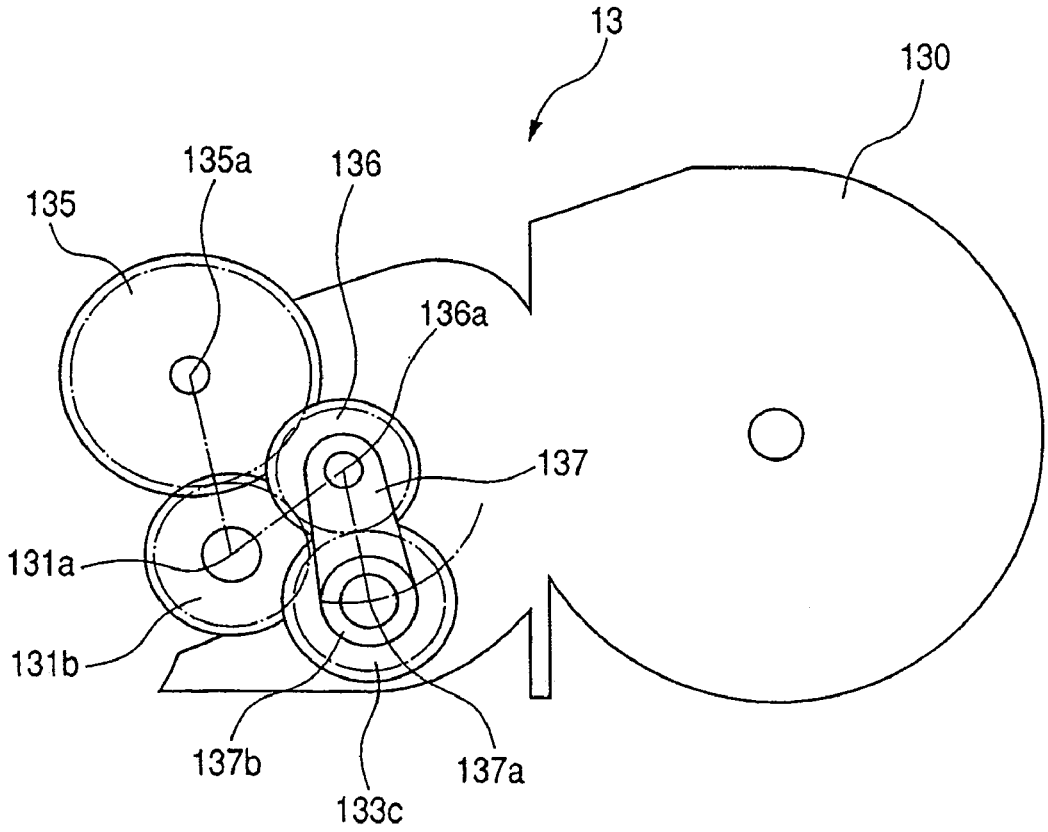
FIG. 4 is a side view showing a state of a developing side cover detached from a developing apparatus in a first embodiment.

FIG. 4 is a side view in case the developing side cover 134 is detached from the developing apparatus 13. As shown in the drawing, the RS roller rocking bearing 137 is engaged with the center axis 136*a* of the RS roller driving gear 136, and is rockingly supported. In the meantime, an engaging portion 137*a* of the RS roller rocking bearing 137 is engaged with the cored bar 133*a* of the RS roller 133, and is rotatably supported. Further, the RS roller rocking bearing 137 is biased to the direction to an arrow mark α1 by unillustrated biasing means.

That is, the RS roller 133 is rockingly supported with the center axis 136*a* of the RS roller driving gear 136 as a center by the above described constitution, and the RS roller 133 is rocked by the present constitution, so that the pushed-in amount with the developing roller 131 can be adjusted.

(RS Roller Rotational Driving Constitution)

Next, a rotational driving constitution of the RS roller 133 will be described by using FIG. 4.

As shown in the drawing, the side surface of the developing apparatus 13 is disposed with a developing driving gear 135, a developing roller gear 131*b*, an RS roller driving gear 136, and an RS roller gear 133*c*. The developing driving gear 135 is drive-transmitted from an unillustrated developing driving input means, and rotationally drives a developing roller gear 131*b*. The developing roller gear 131*b* transmits the driving to the RS roller driving gear 136, and the RS roller gear 133*c* is driven by the RS roller driving gear 136.

As described above, though the RS roller 133 is supported by the RS roller rocking bearing 137 so that the pushed-in amount with the developing roller 131 is adjustable, since the RS roller rocking bearing 137 is supported with the RS roller driving gear center axis 136*a* as a reference, even if the pushed-in amounts of the developing roller 131 and the RS roller 133 are changed, a center distance between the center axis 136*a* of the RS roller driving gear and the RS roller gear 133*c* is always kept constant. Hence, a steady driving transmission is always performed, thereby making a high quality image possible.

(RS Roller Pushed-in Amount Adjustment Mechanism Constitution)

Next, an adjustment mechanism for the developing roller 131 of the RS roller 133 will be described by using FIGS. 3, 5, 6, 7A, 7B and 7C.

Figure 5:
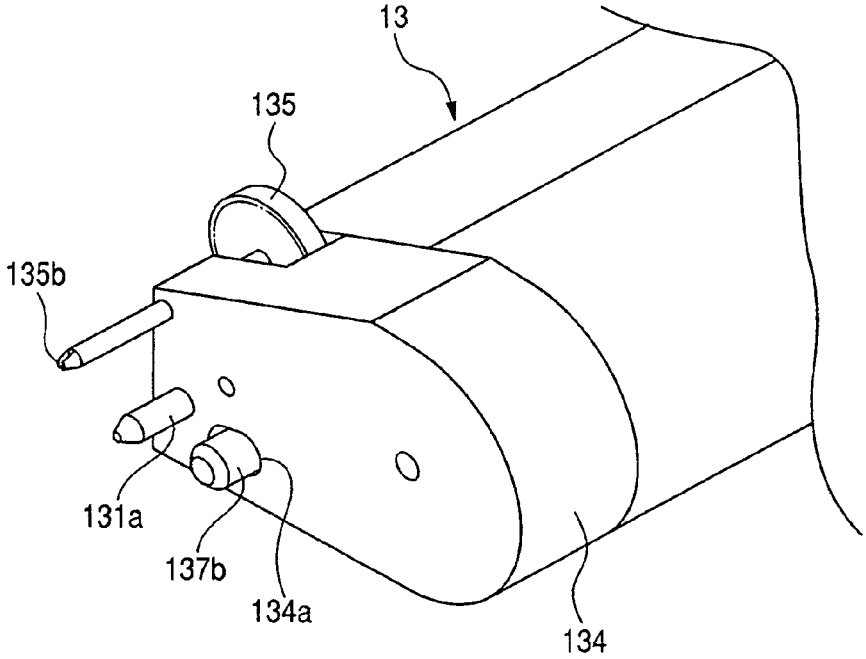
FIG. 5 is an oblique view showing the developing apparatus in the first embodiment.
Figure 6:
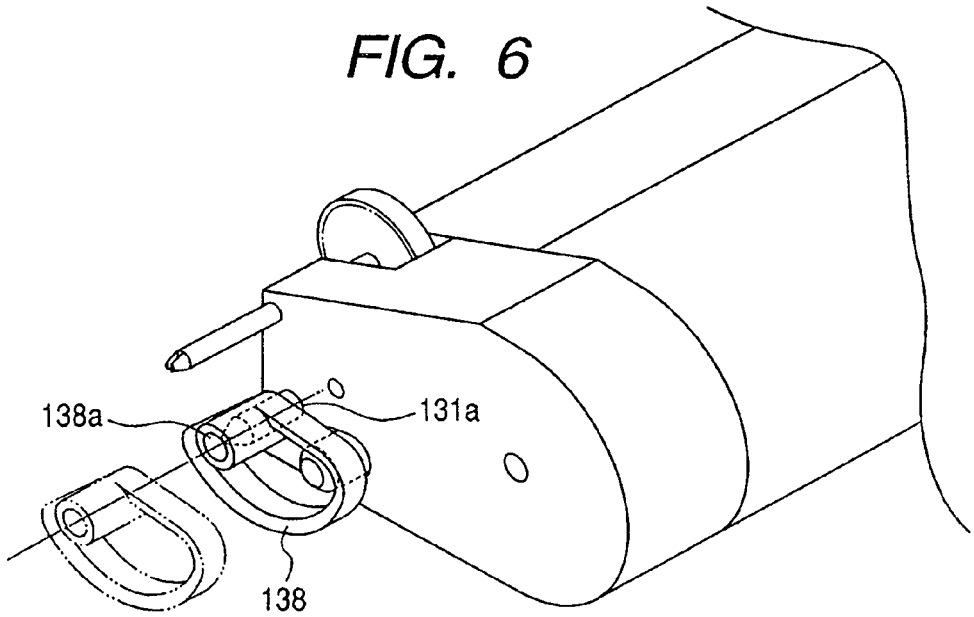
FIG. 6 is an oblique view showing the developing apparatus and a pushed-in amount adjusting cam in the first embodiment.
Figure 7A:
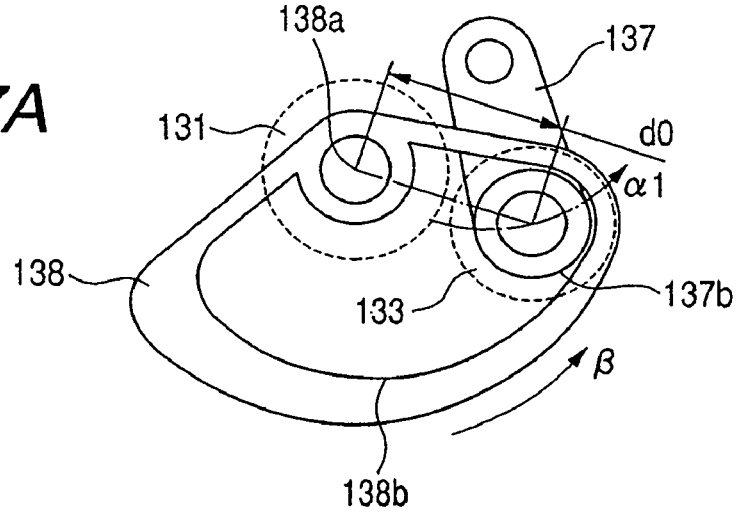
FIGS. 7A, 7B and 7C are schematic illustrations showing an operation status of the pushed-in amount adjusting cam in the first embodiment.
Figure 7B:
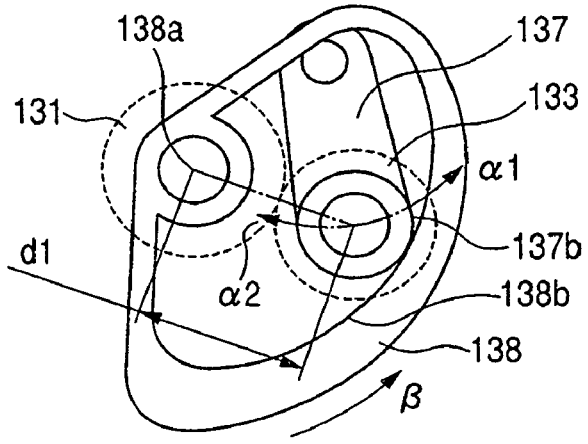
Figure 7C:
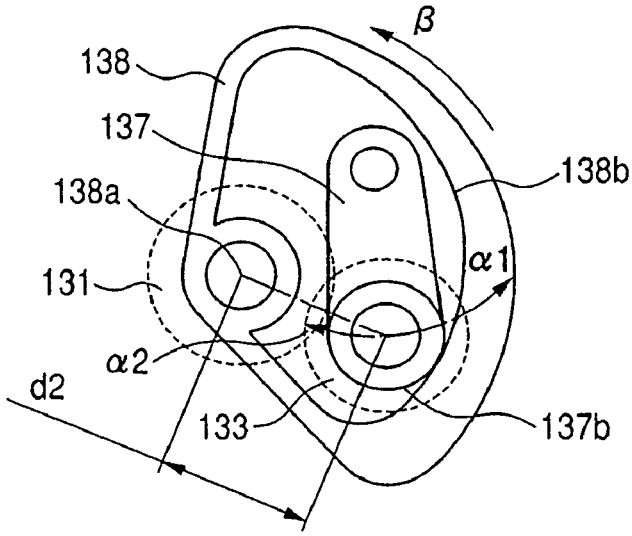

FIG. 5 is an oblique view showing the developing apparatus 13 in the present embodiment, FIG. 6 is an oblique view showing the developing apparatus 13 and the pushed-in amount adjusting cam 138 in the present embodiment, and FIGS. 7A, 7B and 7C are schematic illustrations showing the operation status of the pushed-in amount adjusting cam 138.

In FIG. 5, the side surface of the developing apparatus 13 is disposed with a developing side cover 134, and from the end surface thereof are protruded the driving transmitting portion 135*b* of the developing driving gear 135, a developing roller axis (rotational axis) 131*a*, and the engaging portion 137*b*. As described above, since the engaging portion 137*b* engages with the guide groove 134*a*, the rocking range of the engaging portion 137*b* of the RS roller rocking bearing 137 is regulated by the shape of the guide groove 134*a*. That is, the RS roller 131 can rock in the range of the shape of the guide groove 134*a*. Further, the RS roller rocking bearing 137 is biased to a direction of the arrow mark α1 of FIG. 3 by (unillustrated) biasing means. Hence, in the present embodiment, the shape of the guide groove 134*a* is set in such a manner as to isolate the developing roller 131 from the RS roller 133.

When the developing apparatus 13 (the process cartridge 1 in the present embodiment) is attached to the image forming apparatus main body A, as shown in FIG. 6, the pushed-in amount adjusting cam 138 provided in the image forming apparatus main body A moves from the axial direction of the developing roller 131, so that the developing roller axis 131*a* and the engaging portion 138*a* of the pushed-in amount adjusting cam 138 are engagingly supported. The pushed-in amount adjusting cam 138 can be core-adjusted for the developing roller axis 131*a*, and the pushed-in amount adjusting cam 138 is rotatably supported by unillustrated driving means so as to be set at an arbitrary angle. The driving means is means capable of controlling the pushed-in amount adjusting cam 138 to rotate at an arbitrary angle, and has a function to hold the cam in a rotated state, and for example, a servo motor, a stepping motor and the like can be selected as the means.

In the meantime, the pushed-in amount adjusting cam 138, as shown in FIGS. 7A to 7C, is formed with the cam shape 138*b*. This cam shape 138*b* engages with the engaging portion of the engaging portion 137*b* of the RS roller rocking bearing 137, and rotates with the engaging portion 138*a* as a center at a predetermined angle, and is set in such a manner as to be able arbitrarily change the center distance between the developing roller 131 and the RS roller 133. At this time, as described above, the pushed-in amount adjusting cam 138 is core-adjusted for the developing roller axis 131*a*. That is, the pushed-in amount adjusting cam 138 is supported with the axial center of the developing roller 131 as a reference, and the cam shape 138*b* is guaranteed for the size with this center as a reference. In this manner, the center distance between the developing roller 131 and the RS roller 133 can be surely guaranteed. Hence, the pushed-in amounts of the developing roller 131 and the RS roller 133 can be guaranteed with high accuracy.

Next, the operation of the pushed-in amount adjusting cam 138 will be described by using FIGS. 7A, 7B and 7C. As the pushed-in amount adjustment progresses, the process advances to FIGS. 7A to 7C, and a stage where the developing apparatus 13 is attached to the apparatus main body is shown by FIG. 7A, and a stage where the pushed-in amount adjustment completes under some condition is shown by FIG. 7C.

First, in a state in which the developing apparatus 13 (the process cartridge 1 in the present embodiment) is attached, as shown in FIG. 7A, the cam shape 138*b* of the pushed-in amount adjustment cam 138 and the engaging portion 137*b* of the RS roller rocking bearing 137 mutually have a space. This is because, when the developing apparatus 13 is not attached to the apparatus main body, the above described unillustrated driving means is kept driving so that the pushed-in amount adjusting cam 138 is located at a position of FIG. 7A, and at this time, as described above, since the RS roller rocking bearing 137 is biased in the direction of the arrow mark α1 by unillustrated biasing means and also regulated by the guide groove 134*a* formed in the side cover 134 of the developing apparatus 13, the rocking bearing is always located at the position (isolating position) of FIG. 7A. In this manner, since there is a space between the cam shape 138*b* and the engaging portion 137*b*, the engagement of the developing roller axis 131*a* and the engaging portion 138*a* of the pushed-in amount adjusting cam 138 can be more smoothly performed.

Subsequently, the pushed-in amount adjustment cam 138 rotates in the direction of an arrow mark β by the unillustrated driving means. Then, the cam shape 138*b* and the engaging portion 137*b* abut against each other, and the pushed-in amount adjusting cam 138 further rotates, so that the center distance d0 between the developing roller axis 131*a* and the cored bar 133*a* of the RS roller 133 becomes gradually shorter.

FIG. 7B shows a stage in which the pushed-in amount adjusting cam 138 rotates in the direction of the arrow mark β and the center distance between the developing roller axis 131*a* and the cored bar 133*a* of the RS roller 133 changes from d0 to d1. As shown in the drawing, the pushed-in amount adjusting cam 138 rotates in the direction of the arrow mark β. At this time, since it is biased to the direction of α1 by the unillustrated biasing means, the engaging portion 137*b* of the RS roller rocking bearing 137 and the cam shape 138*b* always abut against each other, and move by following the shape of the cam shape 138*b*. That is, the RS roller rocking bearing 137 rocks in the direction of an arrow mark α2, so that the center distance between the developing roller axis 131*a* and the cored bar 133*a* of the RS roller 133 changes from d0 to d1.

FIG. 7C shows a state in which the pushed-in amount adjusting cam 138 completes the rotation from the state of FIG. 7B further to the direction of the arrow mark β, and finally, the center distance between the developing roller axis 131*a* and the cored bar 133*a* of the RS roller 133 becomes d2. As described above, the pushed-in amount adjusting cam 138 is supported with the developing roller axis as a center. Further, the cam shape 138*b* is formed with the engaging portion 138*a* of the pushed-in amount adjusting cam 138 as a reference, so that, depending on how much angle the pushed-in amount adjusting cam 138 is rotated, the developing roller 131 and the RS roller 133 can be adjusted to an arbitrary pushed-in amount.

(RS Roller Pushed-in Amount Adjusting Method)

Next, an adjusting method of the pushed-in amount of the RS roller 133 for the developing roller 131 will be described by using FIGS. 8 to 10.

The developing apparatus 13 comprises the memory 200 (FIG. 1) (storage means) though not shown. As the memory 200 (FIG. 1), if it is capable of rewritably storing and holding signal information, there is no limit imposed on it. For example, electrical storage means such as RAM, a rewritable ROM and the like, and magnetic storage means such as a magnetic storage medium, a magnetic bubble memory, a magneto-optical memory and the like can be adapted.

As described above, the toner removal performance and the toner supply performance in each RS roller subtly vary depending on the maker difference and the lot difference. Hence, at the production time of the developing apparatus, the pushed-in amount information matched to each RS roller is stored in the memory 200 (FIG. 1), and by that pushed-in amount information, the pushed-in amount is adjusted by using the pushed-in amount adjusting mechanism, so that the usage in an optimum state matched to each of the RS rollers is made possible.

Figure 15:
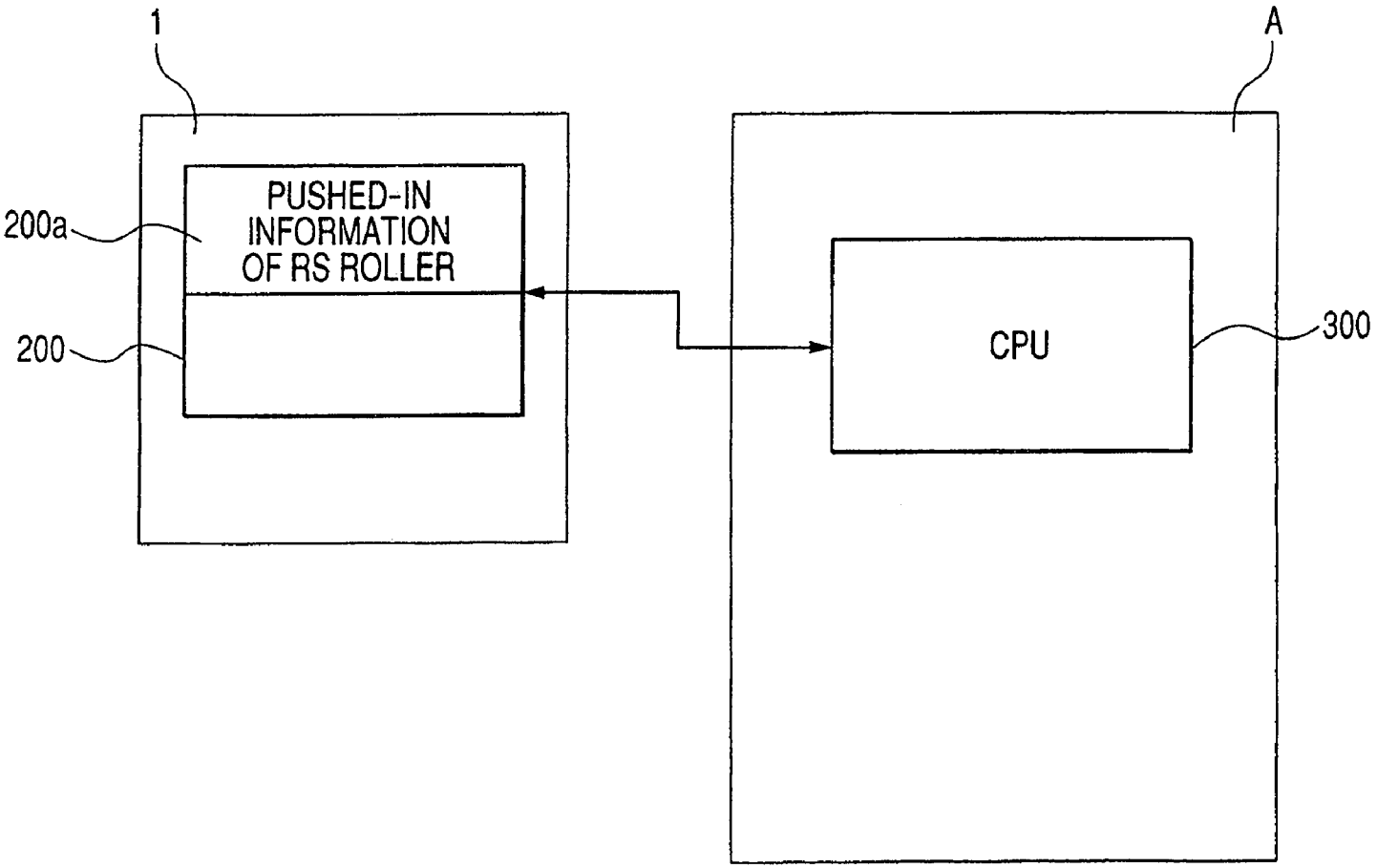
FIG. 15 is a view showing a constitution of a memory 200.

FIG. 15 is a view showing the constitution of the memory 200. The memory 200 is provided with a memory area 200*a* which stores the pushed-in amount information of the RS roller, and at the production time of the developing apparatus, the pushed-in amount information is stored in this memory area. This information is read by the CPU 300 of the image forming apparatus main body, and is loaded into a CPU 301, and by the CPU 301, the adjusting operation described below is executed.

Further, with regard to the information stored in the memory 200, the information on the characteristic of the RS roller may be stored as it is in addition to the pushed-in amount information. As an example of the characteristic information on the RS roller, the maker information, the lot information, and moreover, the number of cells information, the hardness information, the outer diameter information and the like can be cited. These pieces of the characteristic information on the RS roller are read, and the pushed-amount information may be calculated by the CPU 300 of the apparatus main body. At this time, plural types of characteristic information on the RS roller (for example, the maker information, the outer diameter information and the like) cited as an example are stored in the memory 200, and by these pieces of the information, the pushed-in amount is calculated, so that more detailed pushed-in amount adjustment can be made naturally.

Figures 8, 9:
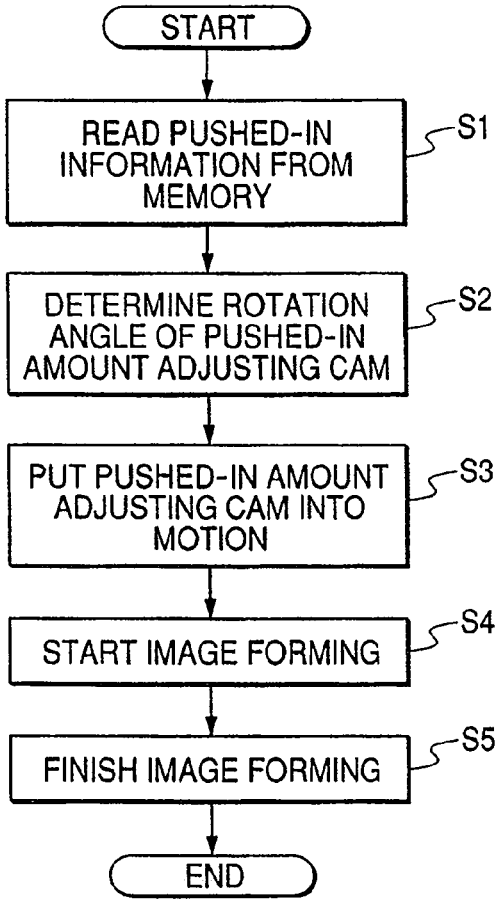
FIG. 8 is a flowchart showing an adjusting operation of the pushed-in amount of an RS roller in the first embodiment.
FIG. 9 is a view showing life information and the corresponding pushed-in amount information in the first embodiment.
Figure 11:
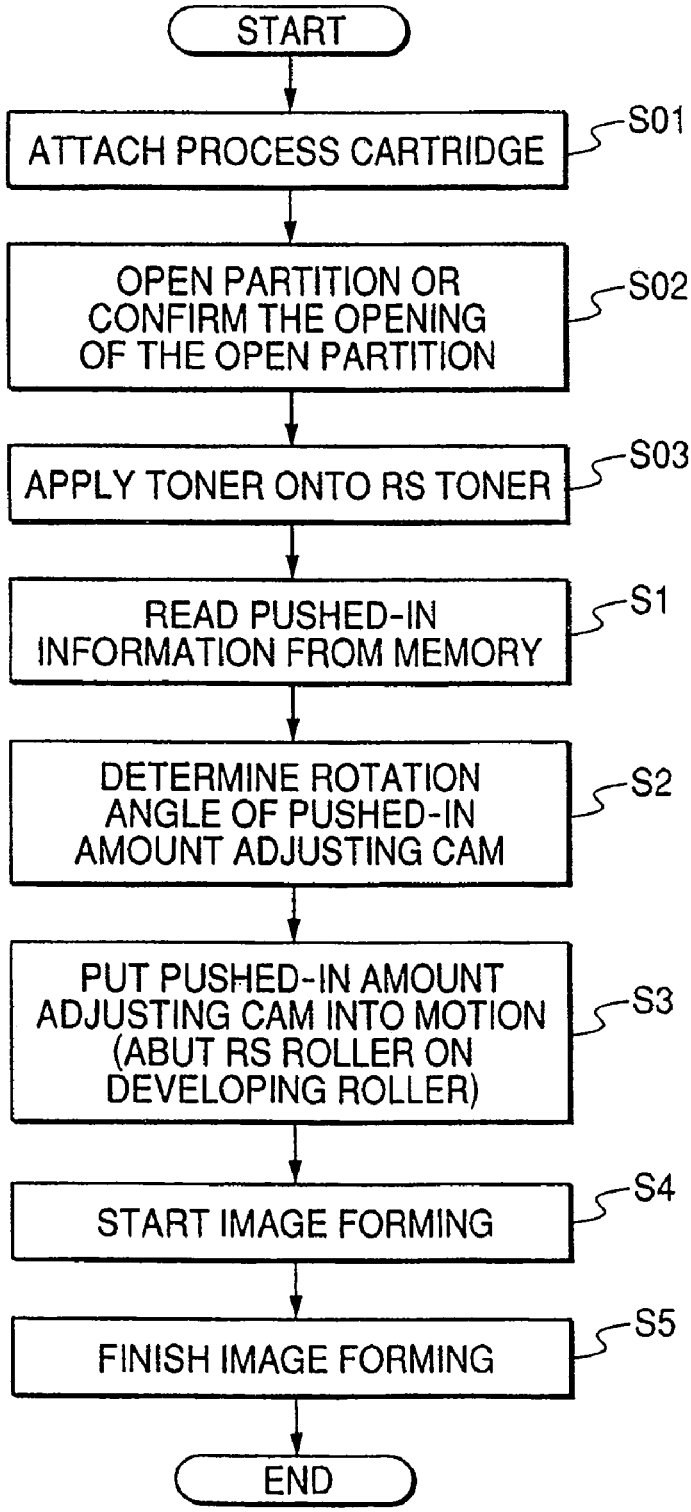
FIG. 11 is a flowchart showing a toner coating operation in the first embodiment.
Figure 12:
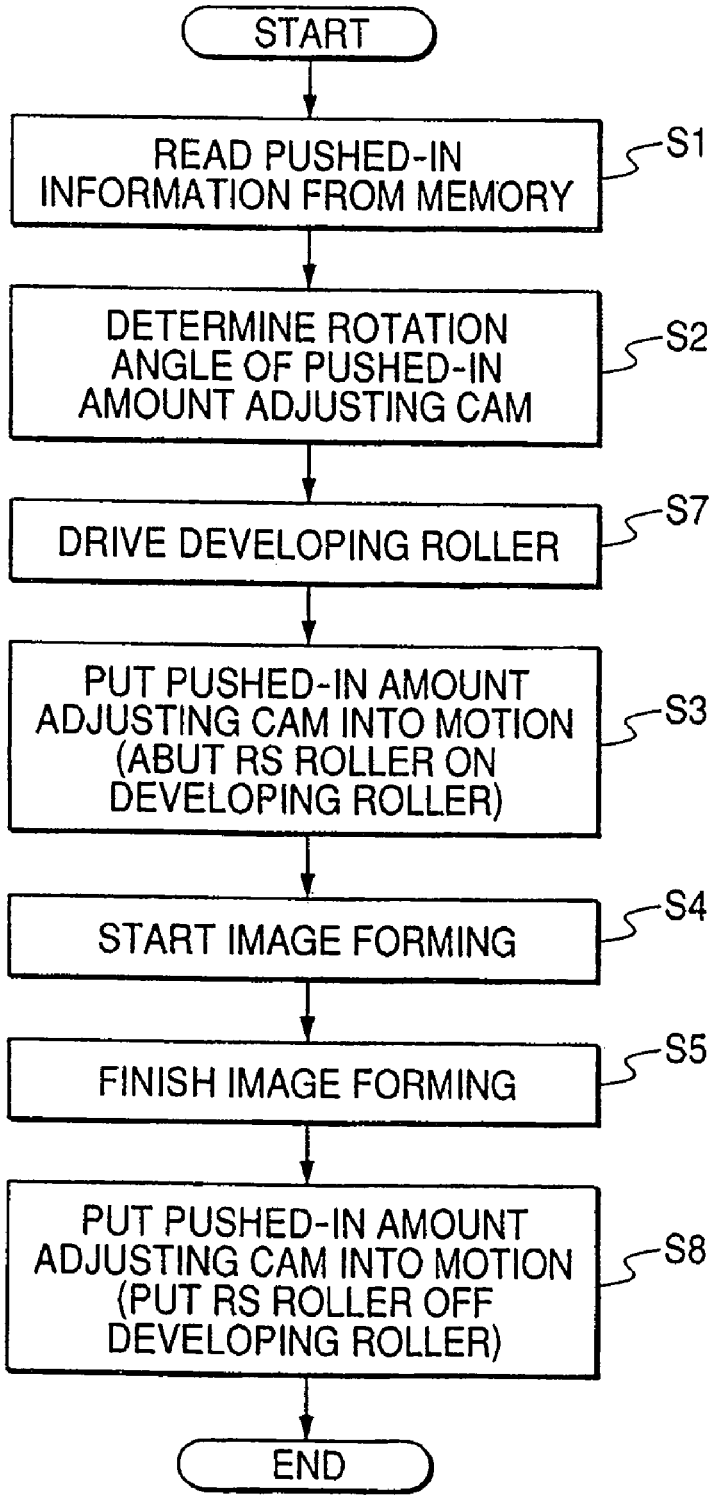
FIG. 12 is a flowchart showing a timing of abutting and alienating of the RS roller in the first embodiment.
Figure 16:
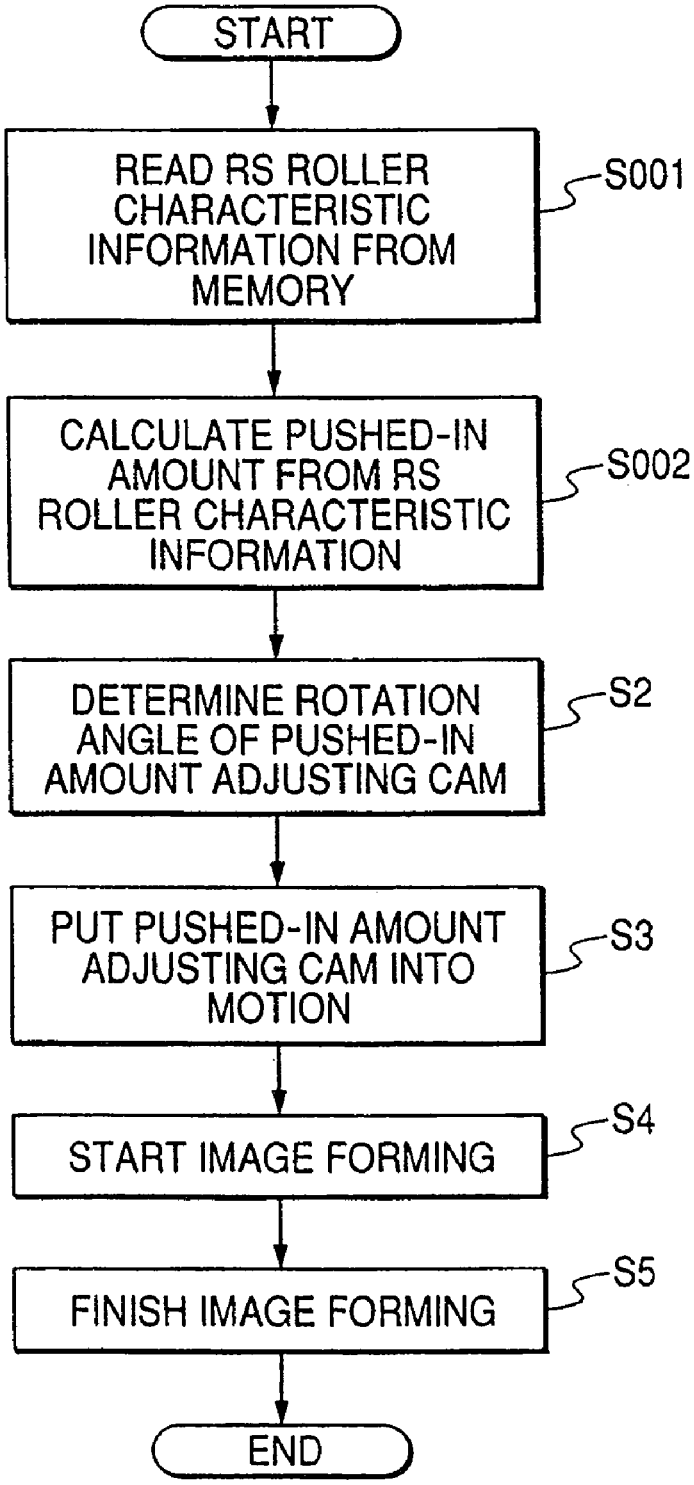
FIG. 16 is a flowchart showing an adjusting operation of the pushed-in amount of the RS roller in the first embodiment.

FIG. 8 is a flowchart showing the adjusting operation of the pushed-in amount of the RS roller 133. The control processing shown in this flowchart and the flowchart to be described later of FIGS. 11, 12 and 16 is executed according to a program stored in advance in the CPU 300 (FIG. 1) provided in the developing apparatus (or image forming apparatus).

First, when the developing apparatus is attached to the apparatus main body, the pushed-in amount information on the RS roller used in the developing apparatus from the memory 200 (FIG. 1) is read (step s1). Subsequently, by calculating means and the like of the apparatus main body, the pushed-in amount information is converted into a rotation angle of the pushed-in amount adjusting cam, and the pushed-in amount is decided (step s2). At this time, by how much angle the pushed-in amount adjusting cam is rotated in advance is stored in the memory 200 (FIG. 1), and using this information may be allowed.

Next, by operating the pushed-in amount adjusting cam, the pushed-in amount is adjusted (step s3), and the image forming is started (step s4) and completed (step s5). In this manner, by using the memory 200 (FIG. 1), the pushed-in amount of the RS roller is adjusted, and therefore, at the production time of the developing apparatus, the pushed-in amount matched in advance to the characteristic of the individual RS roller can be selected, and even if there are the irregularities due to the maker difference and the lot difference in the RS roller, while satisfying the toner removal performance and the toner supply performance, the troubles such as the torque rise, the tearing and furtherance of permanent distortion of the RS roller, and moreover, the deterioration of the toner and the like can be prevented from occurring.

Next, the adjustment of the pushed-in amount by the characteristic information on the RS roller stored in the memory 200 will be described by using the flowchart of FIG. 16. In the drawing, the difference with the flowchart of FIG. 8 is that step s1 (FIG. 8) is replaced by step s001, and step s002 is added. Hence, the description of the same step will be omitted.

As described above, the characteristic information on the RS roller is the maker information, the lot information, and moreover, the number of cells information, the hardness information, the outer diameter information and the like. Based on these pieces of the information, the optimum pushed-in amount is calculated by the CPU 300.

Similarly to the flowchart of FIG. 8 as described above, when the developing apparatus is attached to the apparatus main body, the characteristic information on the RS roller used in that developing apparatus from the memory 200 (FIG. 1) is read (step s001). Subsequently, by the CPU 300, based on this information, the optimum pushed-in amount for the RS roller is calculated (step s002). At this time, the program and correction value which calculates the pushed-in amount from the characteristic information on the RS roller may be stored either in the memory 200 or the CPU 300 of the apparatus main body. In this manner, the pushed-in amount adjustment similarly to the case where the pushed-in amount information described by the flowchart of FIG. 8 is stored in the memory 200 can be made also by the characteristic information on the RS roller.

Hence, in the following description, though a description is made on assumption that the pushed-in amount information is stored in the memory 200, the same control can be made also in the characteristic information on the RS roller.

Further, as described above, the RS roller gradually causes the permanent distortion due to elapse-time usage. Consequently, the life of the developing apparatus is long, and in case the characteristic of the RS roller due to this permanent distortion is not tolerated, then, for example, the life information L1 to L4 as shown in FIG. 9 and the pushed-in amount information dL1 to dL4 in each life are stored in the memory 200 (FIG. 1), so that the adjustment of the pushed-in amount can be made by matching to the life of the developing apparatus.

Figure 10:
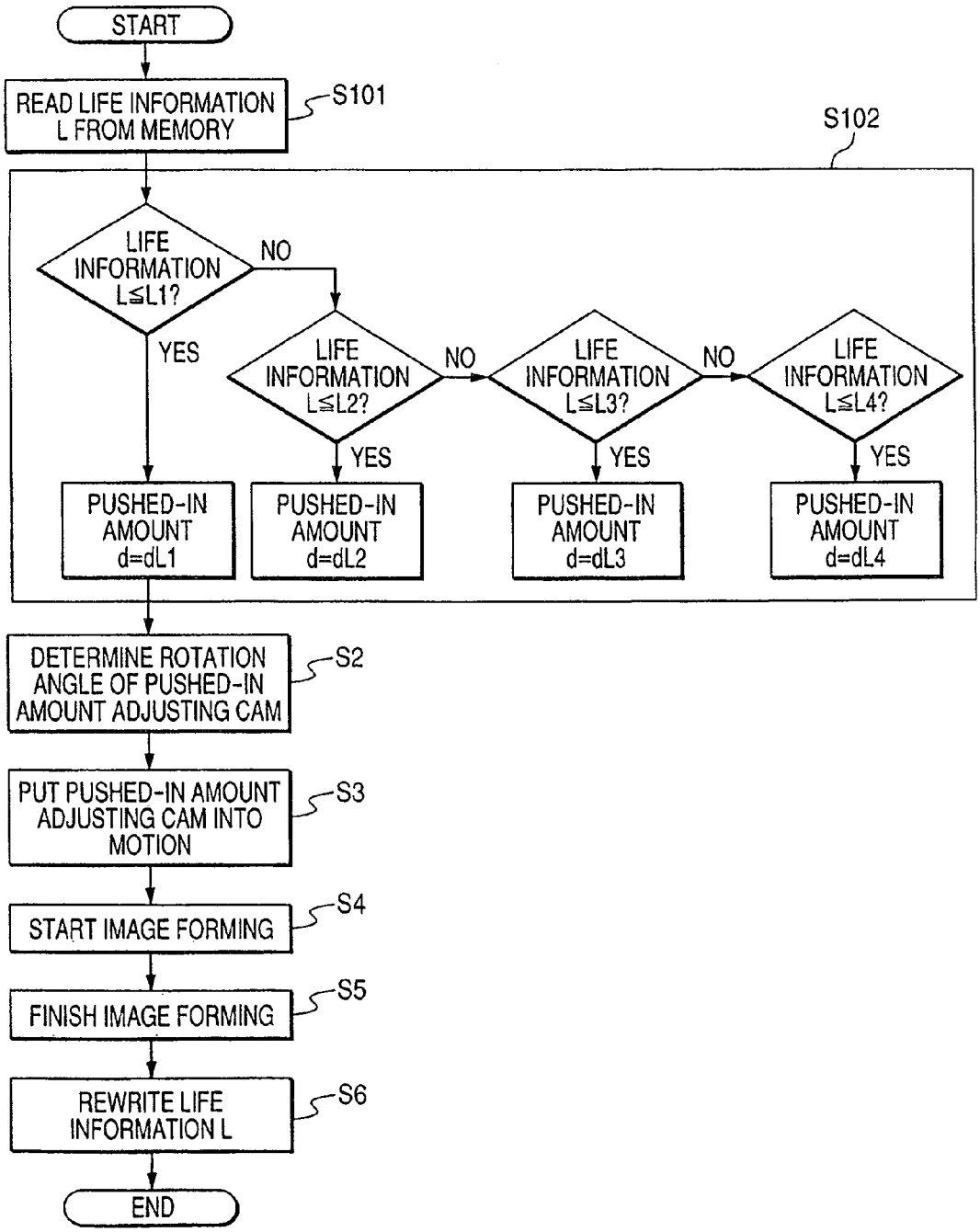
FIG. 10 is a flowchart showing an adjusting operation of the pushed-in amount adjusting cam in the first embodiment.

The operation at this time is shown in the flowchart of FIG. 10. In the drawing, the difference with the flowchart of FIG. 8 is that the portion of step s1 (FIG. 8) serves as steps s101 and s102 and that step s6 is newly added. Hence, the description on the same step portion will be omitted.

When the developing apparatus is operated, the life information L is read from the memory 200 (FIG. 1) (step s101). Subsequently, the pushed-in amount information d corresponding to each life L is read (step s102). At this time, the life information L is compared to L1, L2, L3 and L4, thereby deciding the pushed-in amount information d as dL1, dL2, dL3, and dL4. After the image formation is completed, the life information L is rewritten and renewed (step s6). Next, when the developing apparatus is operated, the flowchart proceeds from START again.

In the present embodiment, though the life of the developing apparatus is divided into four stages, the number of divisions may be adequately selected from the capacity of the memory 200 (FIG. 1), the degree of the permanent distortion of the RS roller, the effect to the image and the like.

In this manner, the pushed-in amount adjustment can be made by taking into consideration the permanent distortion of the RS roller due to elapse-time usage.

(Prevention of Tearing of RS roller)

Next, the prevention of the tearing of the RS roller will be described by using FIGS. 2 and 11. As described above, the RS roller 133 pushes into the developing roller 131 with a predetermined pushed-in amount, and moreover, rotates in a counter direction. Consequently, the surface of the foam layer (sponge layer) 133*b* of the RS roller 133 is applied with an enormous load, and is sometimes torn off. Hence, at the production time of the developing apparatus, the toner is coated in advance on the foam layer 133*b* when the RS roller is built in, and this toner is taken as a lubricant, thereby reducing the load and preventing the tearing.

However, in the present embodiment, the developing apparatus 13, as shown in FIG. 2, is partitioned into the developing chamber 130*a* and the toner containing chamber 130*b* by the partition member 130*c*, and at this time, the toner is stored only in the toner containing chamber 130*b*, and does not exist in the developing chamber 130*a*. The reason why such a constitution is taken is to prevent the toner from flying outside the developing apparatus 13 by the impact and vibration at the time of physical distribution and the like. Further, in the present constitution, by the shape of the guide groove 134*a* formed in the developing side cover 134 and the biasing means which biasing the RS roller rocking bearing 137 to the direction of the arrow mark $\alpha$1, the RS roller 133 and the developing roller 131 are set so as to be in an isolated state. That is, by surely coating the toner of the toner containing chamber 130*b* on the foam layer 133*b* of the RS roller 133 the in this state, the toner coating process for the RS roller at the production time can be curtailed.

The operation at this time will be described by using the flowchart of FIG. 11. FIG. 11 is a flowchart showing the operation of coating the toner before the developing roller and the RS roller in the developing apparatus of the present embodiment abut against each other with a predetermined pushed-in amount and rotate. In this drawing also, the description on the same steps (steps s1 to s5) as FIG. 8 will be omitted.

First, when the process cartridge 1 is attached to the apparatus main body (step s01), the apparatus main body opens (or confirms) the partition member 130*c* by unillustrated opening means (step s02). At this time, the opening of the partition member 130*c* is performed by the user, and the detection of whether or not the partition member 130*c* is opened by unillustrated detecting means is performed, and in case the member is not opened, a method may be adopted, which expedites the opening of the partition member 130*c*. Further, the process cartridge 1 may be constituted in such a manner as not to be attached to the apparatus main body unless the partition member 130*c* is opened. In this case, step s02 can be omitted.

When the partition member 130*c* is opened, though the toner of the toner containing portion enters the developing chamber 130*a*, and the foam layer 133*b* of the RS roller is coated with the toner, to coat the toner more surely, the toner conveying member 139 is operated, and the RS roller 133 is preferably further rotated (step s03). When the RS roller 133 is rotated, if going by the above described driving constitution, the developing roller 131 is also rotated. At this time, since the toner is not borne on the developing roller 131, the developing roller 131 is sometimes slightly deteriorated due to friction with the developing blade 132 and the photosensitive drum 11. Hence, the developing roller gear 131*b* is built with one way clutch and the like, and by inversely rotating the developing driving gear 135, the RS roller 133 can be rotated with the rotation of the developing roller 131 kept being stopped, thereby preventing the deterioration of the developing roller 131. Further, the driving transmission of the RS roller driving gear 136 is allowed to become independent from the developing roller gear 131*b* so that RS roller 133 is driven from another driving input source, whereby the deterioration of the developing roller 131 can be prevented by driving the RS roller 133 with the developing roller 131 kept being stopped.

In this manner, the developing roller 131 and the RS roller 133 are isolated in advance, and the toner i s surely coated o n the foam layer 133*b* of the RS roller 133, s o that the tearing of the foam layer 133*b* can be prevented (even with the toner coating process on the RS roller curtailed) from occurring.

(Abutting and Isolation of RS Roller)

The developing roller 131 and the RS roller 133, as described above, abut against each other with a predetermined pushed-in amount, while rotating in a counter direction. Consequently, the starting torque in case of rotationally driving the developing roller 131 ends up becoming enormously large. Hence, in the present embodiment, when the developing roller 131 is driven, at its starting time, the RS roller 133 is isolated from the developing roller 131 so as to reduce the load applied to the developing roller 131, thereby decreasing the starting torque. At this time, in what timing the RS roller 133 performs abutment and isolation for the developing roller 131 will be described by using FIG. 12. FIG. 12 is a flowchart showing the timing of abutment and isolation of the RS roller 133.

First, when the image information is transmitted to the apparatus main body, the pushed-in amount information of the memory 200 (FIG. 1) is read (step s1), and subsequently, the rotation angle of the pushed-in amount adjusting cam is decided by the calculating means and the like of the apparatus main body (step s2). The developing roller 131 is driven (step s7), and after that, the pushed-in amount adjusting cam is operated, and the developing roller 131 and the RS roller 133 are abutted against each other (step s3). At this time, even when the operations of step s1 and step s2 are executed after step s7, the RS roller may be abutted against the developing roller (step s3) after the timing of driving the developing roller (step s7).

Next, when the image forming is started (step s4) and the image forming is completed (step s5), the pushed-in amount adjusting cam is rotated in a reverse direction to step s3, and the developing roller 131 and the RS roller are isolated (step s8). At this time, even when the developing roller 131 and the RS roller 133 are not completely isolated, if the pushed-in amount is decreased, naturally the starting torque can be brought under control.

In this manner, according to the present constitution, at the starting time of the developing roller 131, the RS roller 133 is isolated (or the pushed-in amount is decreased), so that the starting torque can be brought under low control.

Now, in the present embodiment, though a description was made that the pushed-in amount adjusting cam 138 which is the pushed-in amount adjusting means of the RS roller 133 is provided for the image forming apparatus main body, naturally the constitution in which the process cartridge 1 and the developing apparatus are provided for this apparatus can also obtain the same effect.

As described above, in the present embodiment, even when the characteristic of the RS roller varies, a high quality image can be realized, and at the same time, the tearing of the RS roller can be prevented, and moreover, the deterioration of the developing roller can be prevented, and the starting torque of the developing roller and the RS roller can be decreased.

Second Embodiment

Next, a second embodiment of the present invention will be described by using FIGS. 2, 13, 14A and 14B.

In the description of the present embodiment, the same reference numerals will be attached to the components having common functions, and the description thereof will be omitted.

The present embodiment allows a developing apparatus 13 to contact with and isolate from a photosensitive drum 11 by utilizing a pushed-in amount adjusting cam 138' of the pushed-in amount adjusting mechanism in the first embodiment.

In the developing apparatus of a contact developing system, a developing roller 131 which is a toner bearing member and the surface of the photosensitive drum 11 contact each other. However, as shown in FIG. 2, in case the photosensitive drum 11 rotates in a direction of an arrow mark r, the surface of the photosensitive drum 11 of the upper stream side from a charging roller 12 is unable to be charged for a first round of rotation. At this time, as described above, since the developing roller 131 and the photosensitive drum 11 contact each other, a toner on the developing roller ends up adhering on the surface of the photosensitive drum, and in case this toner contaminates a transferring roller 33, the contamination of the rear side of the transferring material 31 is caused.

Further, in case the image forming apparatus is stopped for a long period, there is a problem that the surface of the developing roller 131 contacts the photosensitive drum 11, so that a permanent distortion is generated and an image defect due to a developing roller cycle is produced Hence, in the present embodiment, when the image formation is not performed, the developing apparatus 13 is isolated from the surface of the photosensitive drum 11, and only when the image formation is performed, the developing apparatus 13 is abutted against the photosensitive drum 11, thereby solving the above described problem.

Figure 13:
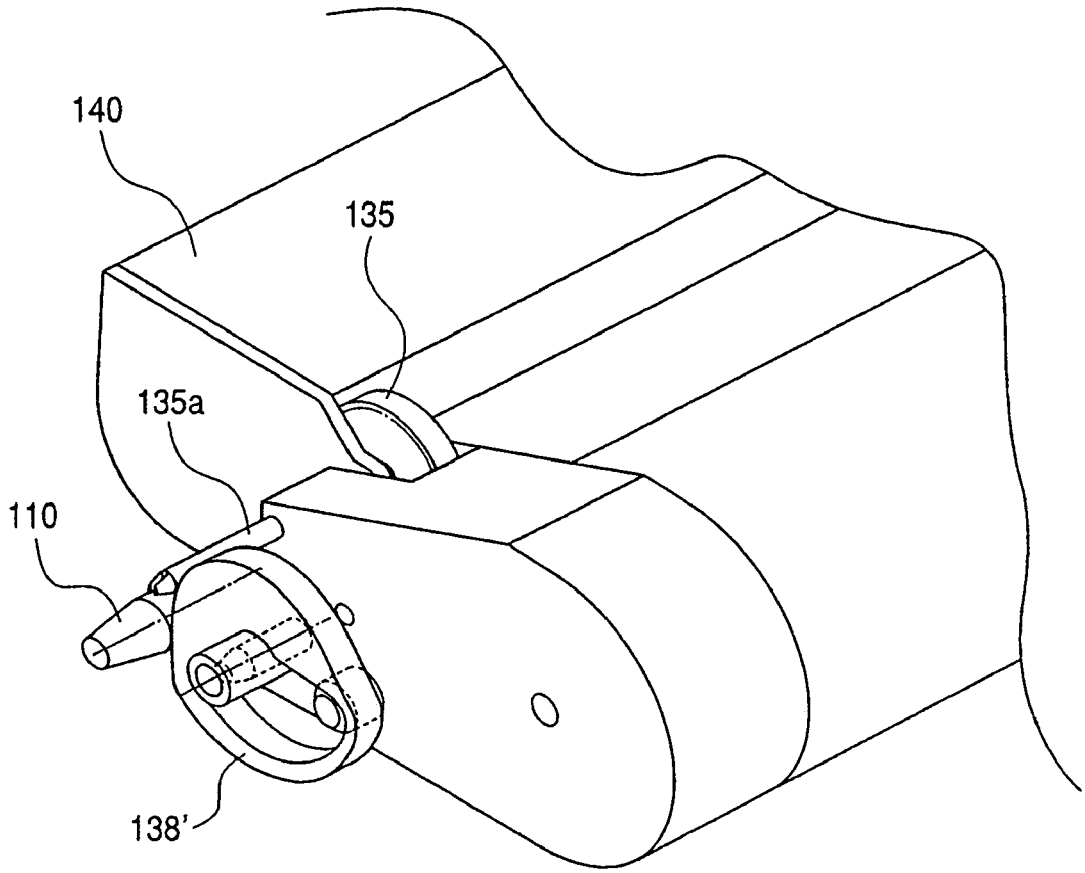
FIG. 13 is an oblique view showing the process cartridge in a second embodiment.

FIG. 13 is an oblique view showing a process cartridge 1 in the present embodiment. The photosensitive drum 11, the charging roller 12, and cleaning means 14 are built into a cleaner framework body 140. Further, the developing apparatus 13 is rockingly supported with a center axis 135*a* of a developing driving gear 135 as a reference for the cleaner framework body 140, and the developing apparatus 13 is biased to a direction where the developing roller 131 and the photosensitive drum 11 abut against each other by unillustrated biasing means. The abutment of the developing roller 131 and the photosensitive drum 11 may utilize a dead load of the developing apparatus 13 without utilizing the biasing means.

In the meantime, the cleaner framework body 140 is formed with a developing isolating abutting portion 110. Further, a pushed-in amount adjusting cam 138 is formed with an isolating cam portion 138*c*1 and a developing roller pushed-in amount regulating portion 138*c*2. In this manner, contacting and isolating means capable of contacting and isolating the RS roller 133 and the developing roller 12 is constituted, and this contacting and isolating means serves also as isolating means.

Figure 14A:
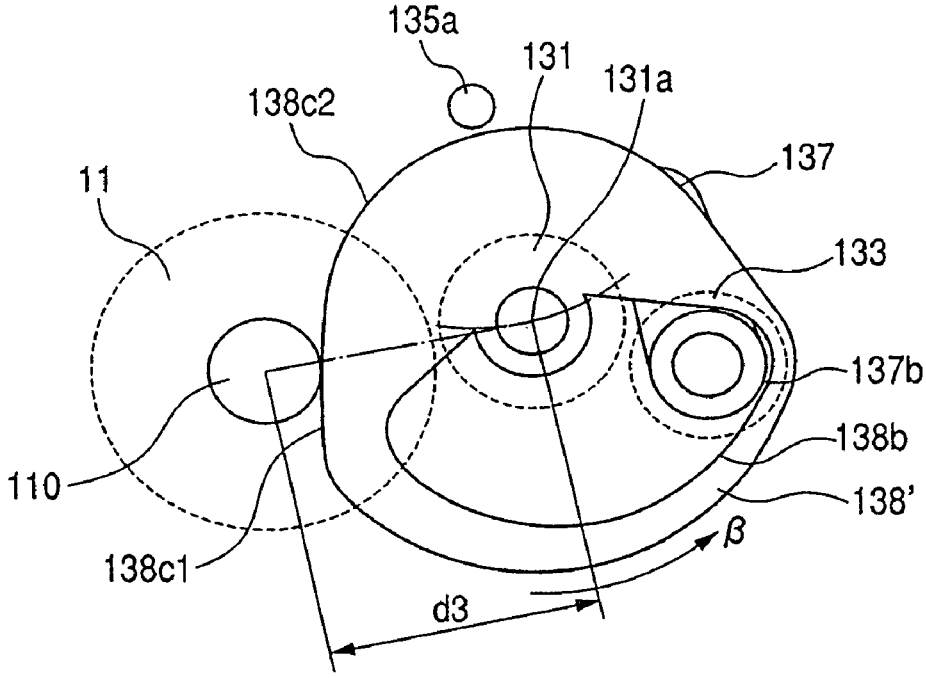
FIGS. 14A and 14B are schematic illustrations showing the operation status of the pushed-in amount adjusting cam in the second embodiment.
Figure 14B:
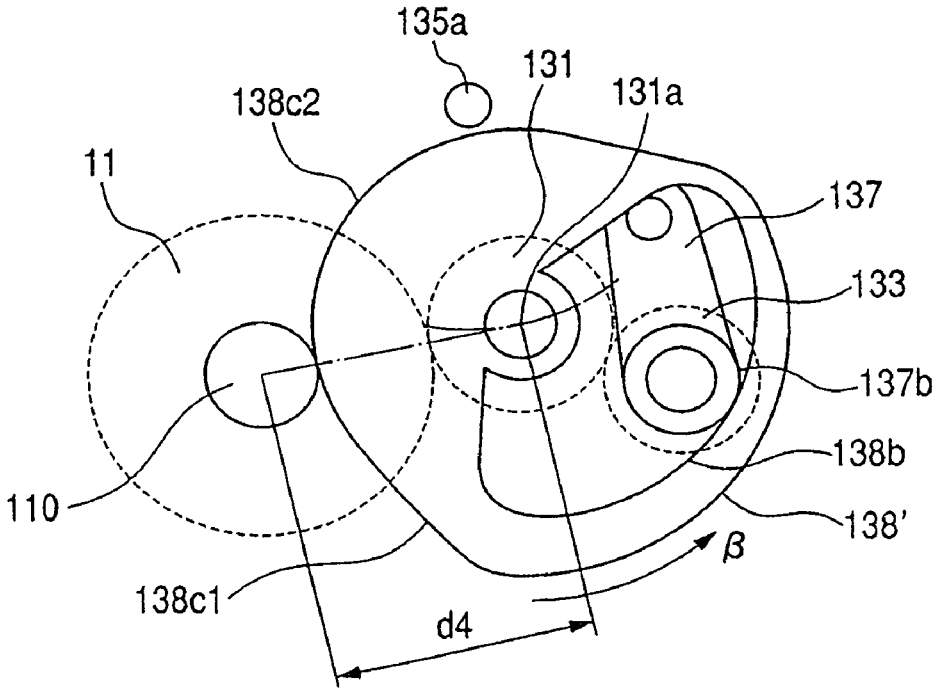

Next, the contact and isolation of the developing apparatus 13 will be described by using FIGS. 14A and 14B. FIGS. 14A and 14B are schematic illustration showing a state in which the developing apparatus 13 is rocked by the movement of the pushed-in amount adjusting cam 138 and the photosensitive drum 11 and the developing roller 131 contact and isolate. FIG. 14A shows a state in which the developing roller 131 and the photosensitive drum 11 are isolated, and FIG. 14B shows a state in which the developing roller 131 and the photosensitive drum 11 abut against each other, respectively.

In FIG. 14A, the isolating cam portion 138*c*1 of the pushed-in amount adjusting cam 138' abuts against the isolating abutting portion 110. As shown in the drawing, the center distance d3 between the photosensitive drum 11 and the developing roller 131 become larger than the sum of the radii of the photosensitive drum 11 and the developing roller 131, and the developing roller 131 and the photosensitive drum 11 are isolated. From this state, as described in the first embodiment, the pushed-in amount adjusting cam 138' rotates in the direction of an arrow mark β at the time of the image formation.

Then, as shown in FIG. 14B, the developing isolating abutting portion 110 abuts against the developing roller pushed-in amount regulating portion 138*c*2. The developing roller pushed-in amount regulating portion 138*c*2 is set to a shape which regulates the pushed-in amount of the developing roller 131 for the photosensitive drum 11, even when the biasing means which performs the abutment of the developing roller 131 and the photosensitive drum 11 and the dead load of the developing apparatus 13 and the like change, the abutting state of the photosensitive drum 11 and the developing roller 131 is always stabilized. Hence, a center distance d4 between the photosensitive drum 11 and the developing roller 131 always becomes an appropriate value, and the pushed-in amount of the photosensitive drum 11 and the developing roller 131 becomes an appropriate value.

Isolating the developing roller 131 and the photosensitive drum 11 again is accomplished by rotating the pushed-in amount adjusting cam 138' in a direction reverse to the previous direction. The timing of contacting and isolating the developing roller 131 and the photosensitive drum 11 may be the same timing as the flowchart 12 described in the first embodiment, whereby the pushed-in amount adjusting cam 138' is operated.

Further, in case the process cartridge 1 is produced and there is a concern about the permanent distortion of the surface of the developing roller 131 to occur during a period before being used by the user, the pushed-in amount adjusting cam 138' is disposed in the process cartridge 1, and is shipped in a state of FIG. 14A by unillustrated lock means and the like, and when the process cartridge 1 is used, this lock means is released, whereby this problem can be also solved.

Although the description was made as above on the embodiments of the present invention, in the present invention, even when the characteristic of the RS roller varies, a high quality image can be realized, and at the same time, the tearing of the RS roller can be prevented, and moreover, the deterioration of the developing roller can be prevented, and the starting torque of the developing roller and the RS roller can be decreased.

That is, by providing the developing apparatus having adjusting means which adjusts the pushed-in amount for the developing roller matched to the characteristic of the RS roller, even when the RS roller having a different characteristic is used, the RS roller can be set to the pushed-in amount matched to that characteristic, so that no troubles such as the tearing and furtherance of the permanent distortion of the RS roller 133, and moreover, no deterioration of the toner and the like are caused, thereby realizing a high quality image.

Further, the detachably attachable developing apparatus is provided with information storage means which stores the characteristic information on the RS roller, and this information storage means is stored with the characteristic information on each RS roller, and by this information, the pushed-in amount is adjusted, so that the pushed-in amount matched to the characteristic of the RS roller in advance at the production time of the developing apparatus can be controlled. Further, the adjustment of the pushed-in amount matched to the change of the characteristic due to elapse-time usage of the RS roller is also accomplished.

Further, from among two characteristics of the RS roller such as the toner removal capability of the developing roller and the toner supply capability to the developing roller, by adjusting the pushed-in amount by at least one or more characteristics, the capability of the RS roller can be optimized.

Further, in the developing apparatus comprising a developing portion in which the developing roller and the RS roller are contained, and a toner containing portion in which the toner is stored, wherein the developing portion and the toner containing portion are partitioned by a partition member, and the partition member is opened at the hour of use, the developing apparatus is constituted such that the RS roller is contactably and isolatably supported for the developing roller by contacting and isolating means, and when the developing portion and the toner containing portion are partitioned at least by the partition member, the developing roller and the RS roller are isolated by the contacting and isolating means, and after the partition member is opened, the developing roller and the RS roller abut against each other by the contacting and isolating means, wherein the partition member is opened, and the toner is coated on the RS roller, and after that, the RS roller is abutted against the developing roller with a predetermined pushed-in amount, so that, even when the toner coating process at the production time is curtailed, the RS roller is in a state of being coated with the toner, and this toner becomes a lubricant for the friction between the developing roller and the RS roller, thereby preventing the tearing of the RS roller from occurring.

Further, after the partition member is opened, the RS roller is rotated for a predetermined hour in a state isolated from the developing roller, so that the toner coating on the RS roller becomes much reliable.

Further, during a period when the RS roller rotates for a predetermined hour in a state isolated from the developing roller, the rotation of the developing roller is stopped, so that the deterioration of the developing roller due to frictions with developing blade and the photosensitive drum can be prevented.

Further, the pushed-in amount of the RS roller is reduced at the starting time of the developing roller or the RS roller is isolated from the developing roller, so that a load applied on the developing roller due to the friction with the RS roller can be reduced, thereby accomplishing the decrease of the starting torque.

Further, when the pushed-in amount of the RS roller is adjusted, since the RS roller rocks with the center of the gear which drives the RS roller as a reference, the center distance between the gear of the RS roller and the RS roller driving gear is always kept constant, thereby accomplishing a steady gear driving and realizing a high image quality.

Further, the pushed-in amount adjusting means of the RS roller is supported approximately coaxial with the rotation axis of the developing roller, so that the center distance between the RS roller and the developing roller can be accurately adjusted, and consequently, the adjustment of the pushed-in amount of the RS roller can be accurately accomplished.

Further, the isolation between the photosensitive drum and the developing roller can be performed at the same time by the contacting and isolating means which contacts and isolating the RS roller and the developing roller, so that the adherence of the toner on the area not chargeable can be prevented in a first round of rotation of the surface of the photosensitive drum of the upstream side from the charging roller, thereby preventing the contamination of the rear side of the transferring material by the toner adherence and the permanent distortion of the developing roller occurred in case the developing roller is left to remain abutted against the photosensitive drum for a long period.

It is to be understood that the present invention is not limited to the disclosed embodiments, and is intended to contain the modifications of the same spirit and scope of the invention.

This application claims priorities from Japanese Patent Application Nos. 2004-082408 filed on Mar. 22, 2004 and 2005-053341 filed on Feb. 28, 2005, which are hereby incorporated by reference herein.

What is claimed is:

1. A developing apparatus for developing a latent image formed on an image bearing member by a developer, the developer apparatus comprising:

a developer bearing member which holds the developer;

a removal supply member abutting against the developer bearing member and removing the developer on the developer bearing member, supplying the developer to the developer bearing member, or removing the developer on the developer bearing member and supplying the developer to the developer bearing member; and adjusting means which adjusts a pushed-in amount for the developer bearing member of the removal supply member according to an initial characteristic of the removal supply member; and storage means which stores information relating to the initial characteristic of the removal supply member and adjusting the pushed-in amount by the storage information, wherein said developing apparatus is detachably attachable to an image forming apparatus of the electrophoto static system.

2. A developing apparatus according to claim 1, wherein the initial characteristic of the removal supply member includes at least one of the removal capability of the developer for the developer bearing member and the supply capability of the developer for the developer bearing member.

3. A developing apparatus according to claim 1, further comprising:

a developing portion in which the developer bearing member and the removal supply member are contained;

a developer containing portion in which the developer is stored;

an openable partition member capable of partitioning the developer portion and the developer containing portion; and contacting and isolating means which abuts and isolates the removal supply member and the developer bearing member, wherein, in a state in which the developer portion and the developer containing portion are partitioned by the partition member, the developer bearing member and the removal supply member are isolated by the contacting and isolating means, and after the partition member is opened, the developer bearing member and the removal supply member are abutted against each other by the contacting and isolating means.

4. A developing apparatus according to claim 3, wherein, after the partition member is opened, the removal supply member rotates for a predetermined time in a state isolated from the developer bearing member, and after that, abuts against the developer bearing member by the contacting and isolating means.

5. A developing apparatus according to claim 4, wherein, while the removal supply member rotates for a predetermined time, the rotation of the developer bearing member is stopped.

6. A developing apparatus according to claim 1, wherein, at the starting time when the developer bearing member is rotationally driven, the removal supply member is isolated from the developer bearing member by the contacting and isolating means or the adjusting means, or the pushed-in amount is reduced.

7. A developing apparatus according to claim 1, wherein the removal supply member rotates by a removal supply member gear, and the removal supply member gear is driven by a removal supply member driving gear, and moreover, the removal supply member is rockably supported with the center of the removal supply member driving gear as a reference.

8. A developing apparatus according to claim 3, wherein the adjusting means or the contacting and isolating means is supported approximately coaxial with the rotation axis of the developer bearing member.

9. A developing apparatus according to claim 3, wherein the contacting and isolating means serves as isolating means for isolating the developer bearing member and the image bearing member.

10. An image forming apparatus, comprising the developing apparatus according to claim 1.

11. A developing apparatus according to claim 1, wherein said adjusting means includes a cam member rotatably provided in said developing apparatus, and wherein said cam member rotates to come into contact with said removal supply member and changes a distance between said removal supply member and said developer bearing member.

12. An image forming apparatus, detachably attachable to a developing apparatus including a developer bearing member holding a developer, and a removal supply member abutting against the developer bearing member and for removing the developer on the developer bearing member, supplying the developer to the developer bearing member or removing the developer on the developer bearing member and supplying the developer to the developer bearing member, the image forming apparatus comprising:

storage means which stores information relating to an initial characteristic of the removal supply member; and adjusting means which adjusts the pushed-in amount for the developer bearing member of the removal supply member based on the information stored in the storage means.

13. An image forming apparatus according to claim 12, wherein the initial characteristic of the removal supply member includes at least one of the removal capability of the developer for the developer bearing member and the supply capability of the developer for the developer bearing member.

14. An image forming apparatus according to claim 12, wherein said adjusting means includes a cam member rotatably provided in a main body of said image forming apparatus, and wherein said cam member rotates to come into contact with said removal supply member and changes a distance between said removal supply member and said developer bearing member.

15. A unit detachably attachable to an image forming apparatus, the unit comprising:

a developer bearing member which supplies a developer to an image bearing member;

a removal supply member abutting against the developer bearing member for removing the developer on the developer bearing member, supplying the developer to the developer bearing member, or removing the developer on the developer bearing member and supplying the developer to the developer bearing member; and storage means which stores information relating to an initial characteristic of the removal supply member, wherein the initial characteristic of the removal supply member includes at least one of the removal capability of the developer for the developer bearing member and the supply capability of the developer for the developer bearing member.

16. A unit according to claim 15, wherein the unit includes the image bearing member.

17. A storage apparatus mountable on a developing apparatus including a developer bearing member holding a developer, and a removal supply member abutting against the developer bearing member for removing the developer on the developer bearing member, supplying the developer to the developer bearing member, or removing the developer on the developer bearing member and supplying the developer to the developer bearing member, the storage apparatus comprising:

a storage area which stores information relating an initial characteristic of the removal supply member, wherein the initial characteristic of the removal supply member includes at least one of the removal capability of the developer for the developer bearing member and the supply capability of the developer for the developer bearing member.

* * * * *